US012702908B2

(12) United States Patent
Richardson et al.

(10) Patent No.: US 12,702,908 B2
(45) Date of Patent: Aug. 11, 2026

(54) DISC GOLF DISC HOLDER

(71) Applicant: MVP Disc Sports, LLC, Marlette, MI (US)

(72) Inventors: Chad Michael Richardson, Marlette, MI (US); Brad Charles Richardson, Marlette, MI (US)

(73) Assignee: MVP Disc Sports, LLC, Marlette, MI (US)

( * ) Notice: Subject to any disclaimer, the term of this patent is extended or adjusted under 35 U.S.C. 154(b) by 412 days.

(21) Appl. No.: 18/524,238

(22) Filed: Nov. 30, 2023

(65) Prior Publication Data

US 2024/0181314 A1 Jun. 6, 2024

Related U.S. Application Data

(60) Provisional application No. 63/429,381, filed on Dec. 1, 2022.

(51) Int. Cl.
*A63B 67/06* (2006.01)

(52) U.S. Cl.
CPC ..... *A63B 67/06* (2013.01); *A63B 2067/063* (2013.01)

(58) Field of Classification Search
CPC ..... A63B 67/06; A63B 2067/063
See application file for complete search history.

(56) References Cited

U.S. PATENT DOCUMENTS

| | | | |
|---|---|---|---|
| 4,676,504 A | 6/1987 | Ponza | |
| 4,798,390 A | 1/1989 | Dooley | |
| 5,066,010 A | 11/1991 | Pingston | |
| 5,520,397 A | 5/1996 | Thompson | |
| D457,767 S | 5/2002 | Schumacher | |
| 6,616,555 B2 | 9/2003 | Bewley | |
| 6,974,396 B2 | 12/2005 | Mauer et al. | |
| D540,409 S | 4/2007 | Martin et al. | |
| 7,214,147 B2 | 5/2007 | Gutierrez | |
| D567,559 S | 4/2008 | Blazer | |
| D577,235 S | 9/2008 | Blazer | |
| 7,997,595 B1 | 8/2011 | Pope | |
| D656,208 S | 3/2012 | Warner | |
| 8,746,711 B1 | 6/2014 | Jarma | |
| 2005/0009646 A1 | 1/2005 | Johnston | |
| 2006/0003857 A1 | 1/2006 | Mauer et al. | |
| 2012/0149504 A1 | 6/2012 | Miller | |
| 2017/0291082 A1* | 10/2017 | Curran | A63B 71/023 |

FOREIGN PATENT DOCUMENTS

ES 5737 U * 2/1941

OTHER PUBLICATIONS

Machine Translation (Year: 1941).*

* cited by examiner

*Primary Examiner* — Brian O Peters
(74) *Attorney, Agent, or Firm* — Reising Ethington P.C.

(57) ABSTRACT

A disc golf disc stand is provided. The disc golf disc stand includes a stand base. The stand base includes a base coupling connected to a basal periphery by at least one coupling support. The basal periphery is configured to rest on a surface, such as the ground. A stand upright is secured to the base coupling and extends vertically upwardly therefrom. A disc stack holder is coupled with the stand upright and includes a stack holder base or plate and at least one stack rest. The disc golf disc stand is configured to carry at least one disc on the stack holder base and stack rest.

15 Claims, 4 Drawing Sheets

DISC GOLF DISC HOLDER

This disclosure relates to innovations in connection with disc golf disc stands.

BACKGROUND

Disc golf has increased and is increasing in popularity. Discs for disc golf are frequently transferred using a bag or a cart. A disc golfer will pack his or her discs into the cart and pull the cart to carry the various discs used during a round of disc golf.

Disc golf discs may be displayed or stored on disc golf storage racks. Such racks typically have vertical walls and a plurality of dowels extending horizontally between the vertical walls. Discs for storage or display are placed on the horizontal dowels between the vertical walls. Other designs for storage and display rack are also known. Disc golf discs are also commonly stored in boxes in disc golf bags or just in stacks without any type of rack or closure. Such racks are not designed for to be portable for use in connection with disc golf play or practice.

In connection with training for disc golf, a disc golfer may practice for long periods of time. It may, therefore, be desirable to have a portable disc golf disc stand that can be used to carry several discs which can be used during practice. In one example, a disc golfer may desire to practice putting. It would be useful to have a plurality of putting discs on a stand easily accessible by the golfer so that the golfer can access the discs and repeat the putting process multiple times. Further it would be desirable that such a stand be relatively easy to move and assemble.

SUMMARY OF THE DISCLOSURE

The present disclosure embodies a number of aspects that can be implemented separately from or in combination with each other.

In an embodiment, a disc golf disc stand is provided. The disc golf disc stand comprises a stand base including a basal periphery that establishes a stand base plane. The stand base further includes a base coupling, and a coupling support between the basal periphery and the base coupling. The disc golf disc stand further comprises a stand upright configured to be coupled to the base coupling which extends along a stand upright longitudinal axis transverse to the stand base plane. The stand upright further includes a lower end configured to be coupled to the base coupling 16 and an upper end. The disc golf disc stand further comprises a disc stack holder configured to be coupled to the stand upright. The disc stack holder includes a stack holder coupling configured to be coupled to the upper end of the stand upright, and a stack holder base coupled to the stack holder coupling and establishing a stack holder base plane. The disc stack holder further includes a plurality of stack rests extending along stack rest longitudinal axes transverse to the stack holder base plane.

In an embodiment, a disc golf disc stand is provided. The disc golf disc stand comprises a stand base. The stand base includes a basal ring establishing a stand base plane a central base socket at a center of the basal ring, and a plurality of socket support legs coupled to and extending between the basal ring and the central base socket. The disc golf disc stand further comprises a stand upright carried in the central base socket that extends along a vertical axis transverse to the stand base plane. The stand upright includes lower end carried in the central base socket, and an upper end. The disc golf disc stand further comprises a disc stack holder. The disc stack holder includes a stack holder coupling configured to be coupled with the upper end of the stand upright, a stack holder plate coupled to the stack holder coupling and establishing a stack holder base plane extending at an angle between 30 and 60 angular degrees with respect to the longitudinal axis of the stand upright, and a plurality of stack rests extending along longitudinal axes at an angle between 85 and 95 angular degrees with respect to the stack holder base plane

DETAILED DESCRIPTION

A disc golf disc stand is generally shown at 10 in the Figures. In an embodiment, the disc golf disc stand 10 includes a stand base generally indicated at 12. The stand base 12 may comprise a basal periphery 14 and a base coupling 16. The basal periphery 14 defines a stand base plane. The basal periphery 14 may be configured to contact the ground and may be circular, as shown in the Figures. The basal periphery 14 can be made of any suitable material, such as by way of example, tubular or solid metal or plastic. In an embodiment, the basal periphery 14 may comprise metal rod or wire stock that is formed into the circular shape. The basal periphery 14 in this embodiment may, therefore, comprise a basal ring. It will be appreciated, however, that the basal periphery 14 may take any suitable geometric configuration. Furthermore, the basal periphery 14 need not comprise a fully connected periphery as shown. That is, the basal periphery 14 may comprise a series of discrete geometries. By way of non-limiting example, the basal periphery 14 may comprise one or more feet (not shown) which are configured to contact the ground. The feet may take any suitable geometric configuration.

Figure 5:
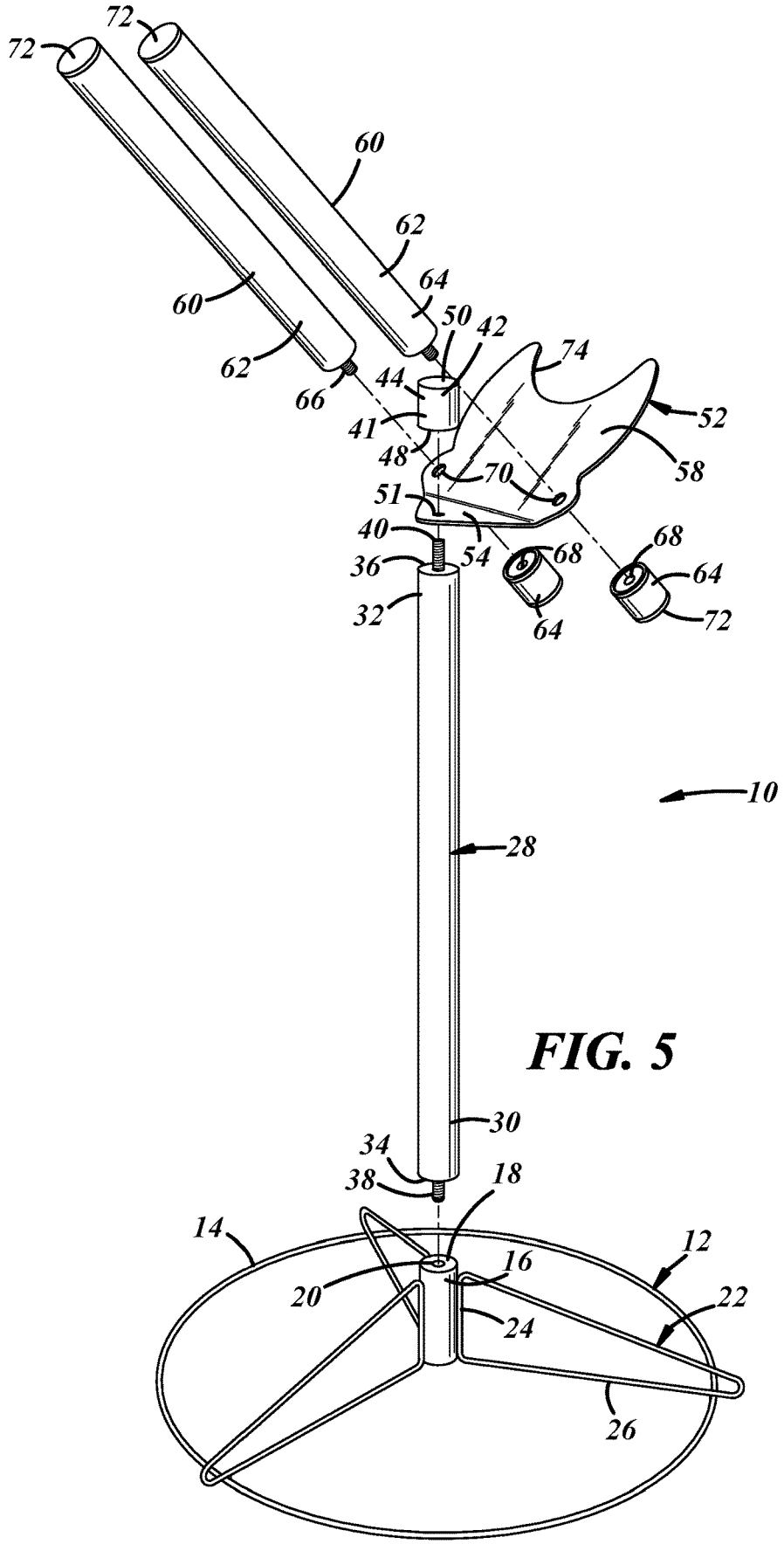
FIG. 5 is an exploded view of an embodiment of a disc golf disc stand.

In the embodiment shown, the base coupling 16 comprises a cylindrical coupling 16. The base coupling 16 may comprise a hollow tubular structure having a circular cross section. It will be appreciated, however, that the base coupling 16 may comprise any suitable geometric cross-section. Further, the base coupling 16 may be solid in alternate embodiments. The base coupling 16 preferably has a top 18. In the embodiment shown in the Figures, the top 18 defines an opening 20 configured for attaching a stand upright, which will be described in further detail below. In an embodiment as best seen in FIG. 5, the top 18 defines a female threaded opening 20. In an embodiment, the base coupling 16 comprise a central base socket at a center of the basal ring.

The stand base 12 further comprises at least one coupling support generally indicated at 22. In the embodiment shown, the stand base 12 includes three coupling supports 22. The coupling supports 22 may be spaced around the periphery of the base coupling 16 at about 120 degree intervals. The coupling supports 22 extend between base coupling 16 an the basal periphery 14. As shown, the coupling supports 22 may be generally triangular in nature. The coupling supports 22 can be made of any suitable material, such as by way of example, tubular or solid metal or plastic. In an embodiment, the coupling supports 22 may comprise metal rod or wire stock that is formed into the generally triangular shape.

A first leg 24 of the coupling support 22 may be secured to the to the base coupling 16 in any suitable manner. By way of example, the first leg 24 of the coupling support 22 may be welded to the base coupling 16. Each coupling support 22 may also be secured to the basal periphery 14. The coupling supports 22 thus couple the base coupling 16 with the basal periphery 14. Each coupling support 22 may include a second leg 26 that extends from the first leg 24 radially outwardly in the direction of the basal periphery 14. The second leg 26 may be secured to the basal periphery 14 in any suitable manner. It will be appreciated that in other embodiments, not shown, the number and geometric configuration of coupling supports 22 may be varied. Additionally, the spacing of the coupling supports 22 about the base coupling 16 may also vary. In the embodiment shown, the second leg 26 of the coupling supports 22 engage a surface on the basal periphery 14 is not in contact with the ground. In this manner, the coupling supports 22 do not interfere with the portion of the basal periphery 14 that is configured to contact the ground.

The disc golf disc stand 10 further comprises a stand upright generally indicated at 28. The stand upright 28 may comprise any suitable material, such as by way of example, metal or plastic. The stand upright 28 is configured to be coupled with the base coupling 16. The stand upright 28, in the embodiment shown, is tubular having a circular cross section, forming a tubular stand pole. It will be appreciated, however, that the stand upright 28 may take any suitable geometric configuration, and may be solid. Furthermore, the stand upright 28 may extend from a lower end 30 to an upper end 32 along a stand upright longitudinal axis A that is transverse to the stand base plane. In one embodiment, the stand base plane may be horizontal and the longitudinal axis of the stand upright 28 may be perpendicular thereto to extend vertically upward with respect to the stand base plane. The stand upright 28 may extend any suitable length along the longitudinal axis A.

In the embodiment shown, the stand upright 28 is a hollow tube that has closures on the respective lower 30 and upper 32 ends of the tube. That is, the stand upright 28 contains a lower end closure 34 and an upper end closure 36. The lower end closure 34 may include a threaded extension 38 as best seen in FIG. 5. The threaded extension 38 of the lower end closure 34 may be received in the female threaded opening 20 of the base coupling 16 to secure the stand upright 28 with the base coupling 16.

In an embodiment, the upper end closure 36 may include an upper end threaded extension 40. The upper end threaded extension 40 bay be used to secure a stand upright cap, as will be described in more detail below.

In some embodiments, more than one stand upright 28 may be used. That is, two or more stand uprights 28 may be connected together. In such embodiments, a first stand upright 28 may be configured as above and secured to the base coupling 16 as previously described. A second stand upright 28 may be configured such that the lower end closure 34 defines a threaded opening (not shown) to receive the upper end threaded extension 40 of the first stand upright to which the second stand upright 28 is secured. That is, the upper threaded extension 40 of the first upright can be threadedly secured to the threaded opening (not shown) of the second stand upright 28. The use of one or more stand uprights 28 allows for adjustment of the overall length of the stand upright 28 of the disc golf disc stand 10.

The upper end 32 of the last stand upright 28 is configured to receive a stand upright cap 42. The stand upright cap 42 may be tubular, having a circular cross section. It will be appreciated, that the stand upright cap 42 may comprise any suitable geometric configuration. Further, the stand upright cap 42 may comprise any suitable material, by way of example, metal or plastic. The stand upright cap 42 includes a lower end 46 and an upper end 44. The lower end 46 includes a lower end closure 48. The lower end closure 48 may define a threaded opening, not specifically shown, for receiving the upper end threaded extension 40 of the stand upright 28 which can be used to secure the upright cap 42 with the stand upright 28. The upper end 44 of the stand upright cap 42 may be closed off in any suitable manner. In one embodiment, a plug 50 is fit into the upper end 44 of the stand upright cap 42. It will also be appreciated that the upper end 44 may be left open when desired.

The disc golf stand disc 10 further comprises a disc stack holder generally indicated at 52. The disc stack holder 52 is configured to be coupled to the stand upright 28. In an embodiment, the disc stack holder 52 is configured to be coupled to the upper end 32 of the stand upright 28. The disc stack holder 52 comprises a stack holder coupling 54 coupled with the stand upright 28. The stack holder coupling 54 defines an opening 56 that is configured to be placed on the upper end 32 of the stand upright 28. The opening 56 allows the disc stack holder 52 to be positioned on the upper end 32 of the stand upright 28 while also allowing the stand upright cap 42 to be secured to the stand upright 28. The opening 56 preferably is sized to allow the disc stack holder 52, and more particularly the stack holder coupling 54 thereof to be sandwiched or trapped between the upper end 32 of the stand upright 28 and the lower end 46 of the stand upright cap 42

The disc stack holder 52 further includes a stack holder base 58. The stack holder base 58 is coupled with the stack holder coupling 54. In an embodiment, the stack holder base 58 and stack holder coupling 54 are formed as a single piece. It will be appreciated, however, that any manner of coupling the stack holder base 58 with the stack holder coupling 54 may be used.

The disc stack holder base 58 may be oriented so as to extend transversely to the stand longitudinal axis A. In the embodiment shown, the stack holder coupling 54 extends perpendicularly to the stand longitudinal axis A. The stack holder base 58 is angled with respect to the stack holder coupling 54. In an embodiment, the stack holder base 58 establishes a stack holder base plane that extends obliquely with respect to the stand longitudinal axis A. In an embodiment, the stack holder base plane extends at an angle between 30 and 60 angular degrees, inclusive, with respect to the longitudinal axis of the stand upright. It will be appreciated however, that in alternate embodiments, the stack holder base plane can extend between 0 and 90 angular degrees, inclusive, with respect to the stand longitudinal axis A.

The disc stack holder 52 further comprises at a plurality of stack rests 60. In the embodiment shown, two stack rests 60 are shown. It will be appreciated that any number of stack rests 60 may be used. In the embodiment shown, each stack rest 60 comprises a tubular configuration having a circular cross section, forming tubular poles. It will be appreciated that each stack rest 60 may take any suitable geometric configuration, and may also be solid rather than tubular. Further, each stack rest 60 may comprise any suitable material, by way of example, metal or plastic. In an embodiment, the stand upright 28 and each stack rest 60 may comprise a tubular configuration heaving a circular cross section of equal diameter.

Each stack rest 60 is coupled with the stack holder base 58. Stack rests 60 extend along stack rest longitudinal axes B that are transverse to the stack holder base plane. In an embodiment, each stack rests extends along longitudinal axes at an angle between 85 and 95 angular degrees, inclusive, with respect to the stack holder base plane. In the embodiment shown, each stack rest 60 comprises an upper portion 62 and a lower portion 64. The upper portion 62 extends from one side of the disc stack holder base 58 and the lower portion 64 extends from the other side of the disc stack holder base 58. The upper portion 62 may include a male threaded extension 66. The lower portion 64 may define female threaded opening 68.

The stack holder base 58 defines openings 70 configured to allow the male threaded extension 66 to pass therethrough, while not allowing the stack rest 60 to pass therethrough. The lower portion 64, and particularly the threaded female threaded opening 68 can receive the male threaded extension 66 which can be secured to couple each stack rest 60 with the stack holder base 58. In the embodiment shown, the openings 70 do not allow the lower portions 64 of the stack rests 60 to pass therethrough. In this manner, the stack rests 60 sandwich or trap the stack holder base 58 between the upper portion 62 and lower portion 64 of the stack holder base 58. Each of the upper portions 62 and lower portions 64 of the stack rests 60 may include a plug 72 to cover the open ends of each stack rest 60.

Figure 2:
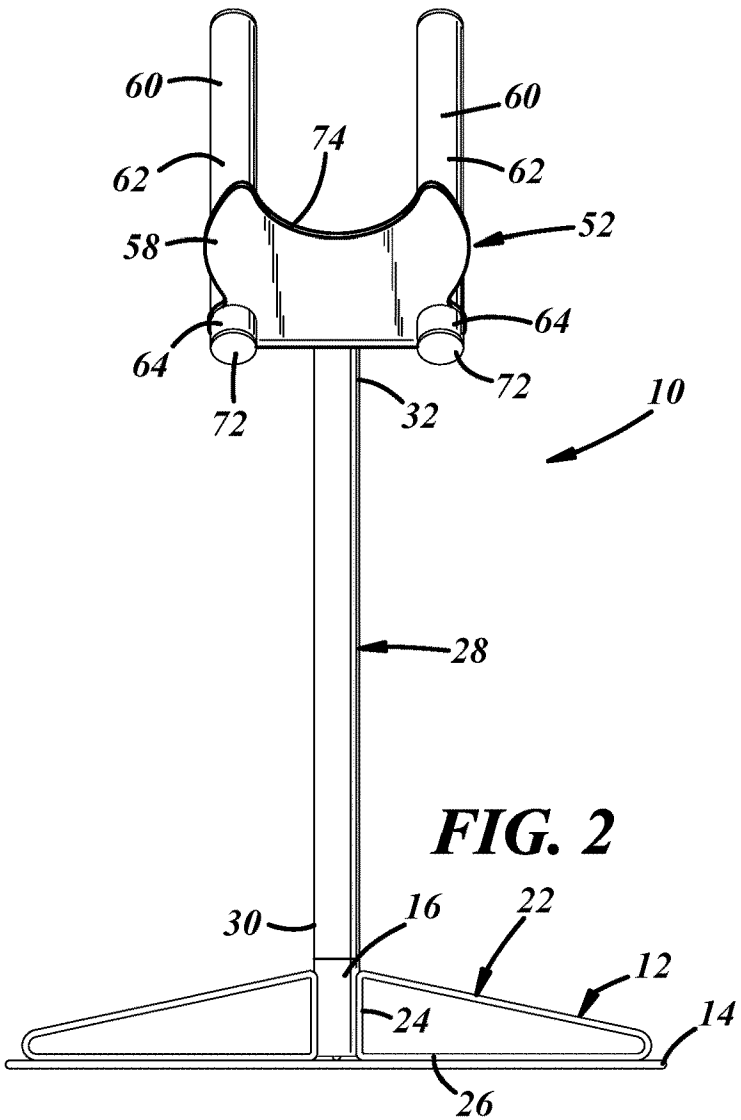
FIG. 2 is a front view of an embodiment of a disc golf disc stand.
Figure 1:
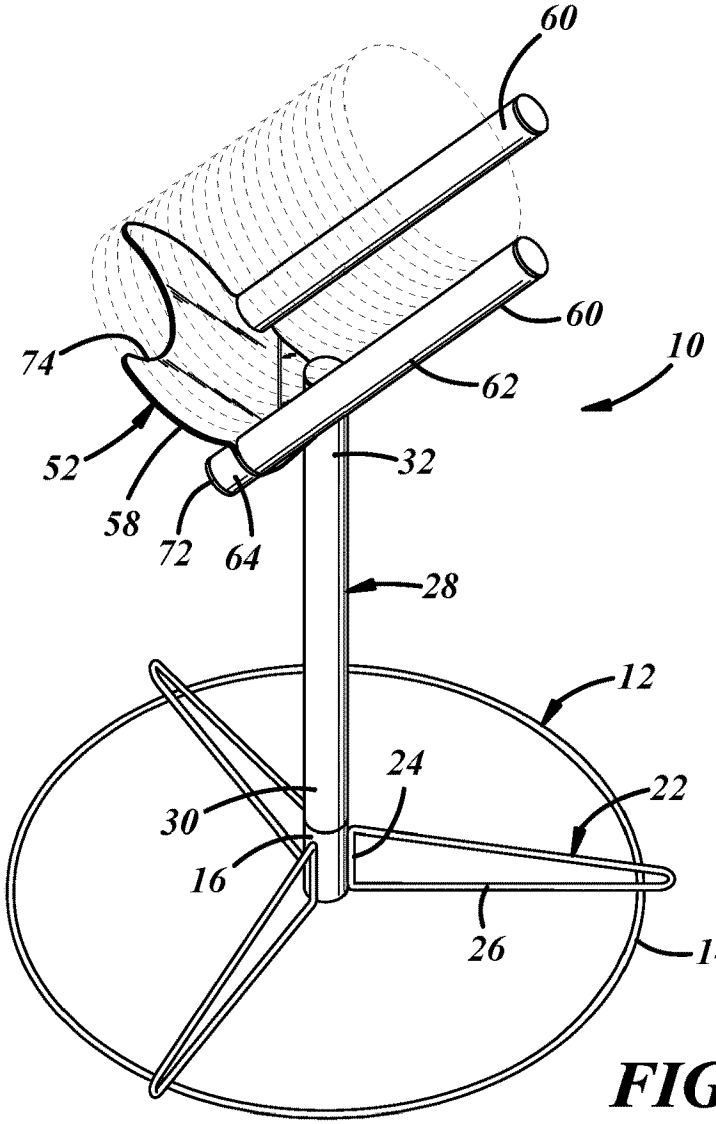
FIG. 1 is s a perspective view of an embodiment showing a disc golf disc stand having discs thereon shown in phantom.
Figure 4:
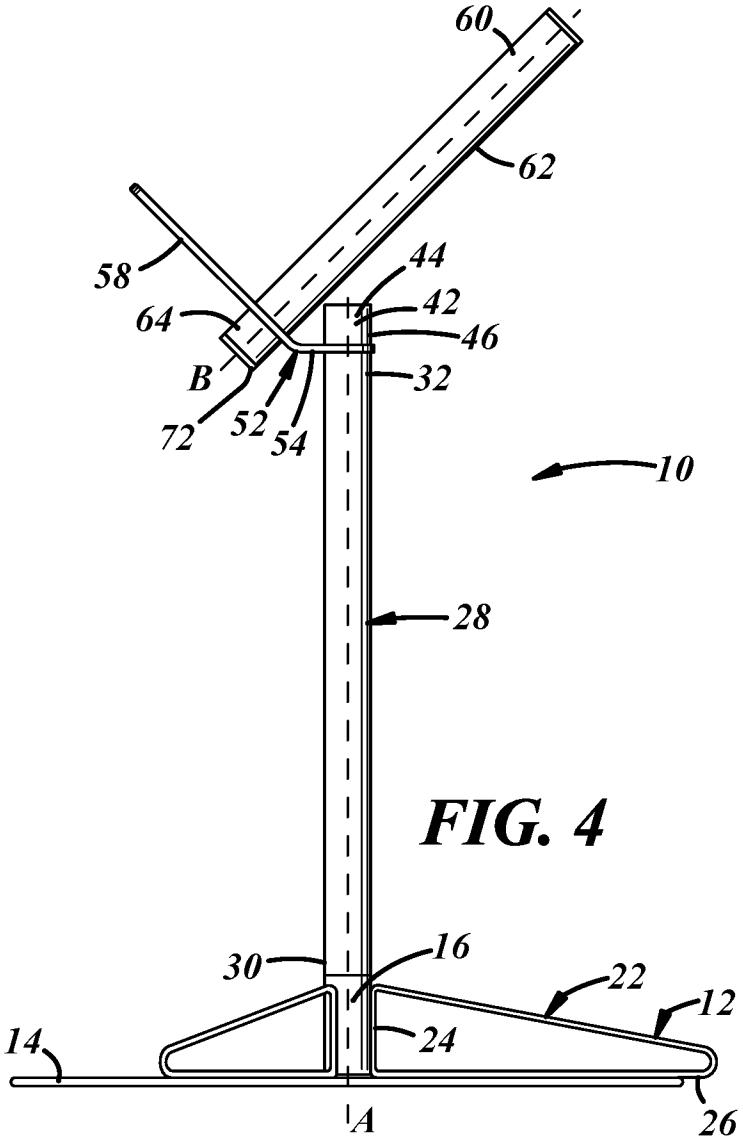
FIG. 4 is a side view of an embodiment of a disc golf disc stand.
Figure 3:
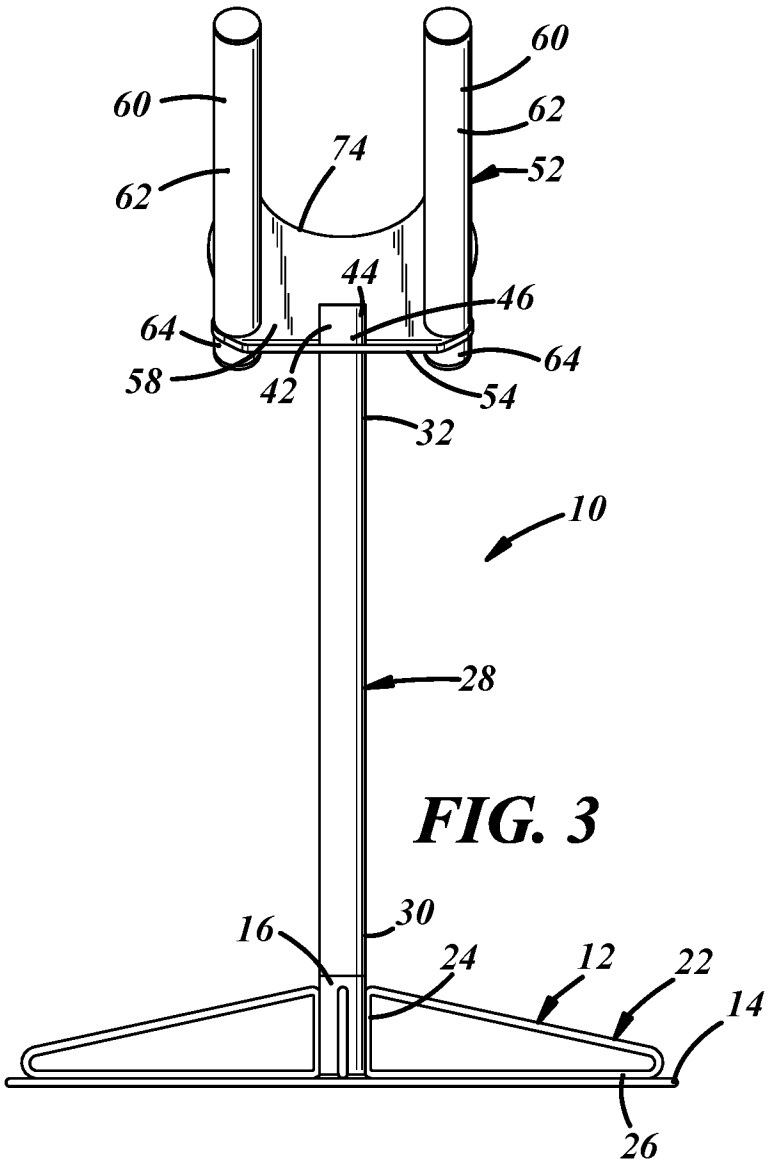
FIG. 3 is a rear view of an embodiment of a disc golf disc stand.

The disc stack holder 52 is configured to support one or more discs, such as those used for disc golf. The discs, shown in phantom in FIG. 1, are supported by the disc stack holder 52. More specifically, the discs can be stacked upon one another and placed on the stack holder base 58. While the discs are supported on the stack holder base 58, the discs are also supported by the stack rests 60. In the embodiment shown, the stack holder base 58 comprises a generally circular plate having a cut out area 74. The cut out area 74 provides an area where a user can grasp a disc from the stack without interference from the stack holder base 58. In the embodiment shown, the arrangement of the stack holder coupling 54, stack holder base 58 and stack rests 60 allows the discs to be retained on the disc stack holder 52. Further, the arrangement shown allows a user to remove a disc from the bottom of the stack of discs and then allows gravity to assist the retaining of the remainder of the discs on the stack holder base 58.

In an embodiment the diameter of the generally circular stack holder base 58 is slightly larger than the discs supported thereon. It will be appreciated, however, that the diameter of the stack holder base 58 may be any suitable diameter to support discs thereon, and need not necessarily be larger than the discs supported thereon. Further, the stack holder base 58 need not be circular. It will be appreciated that the shape of the stack holder base 58 can change. Similarly, while a cut out area 74 is shown to be semispherical, any aesthetically pleasing shape cut out area 74 can be used.

Figure 7:
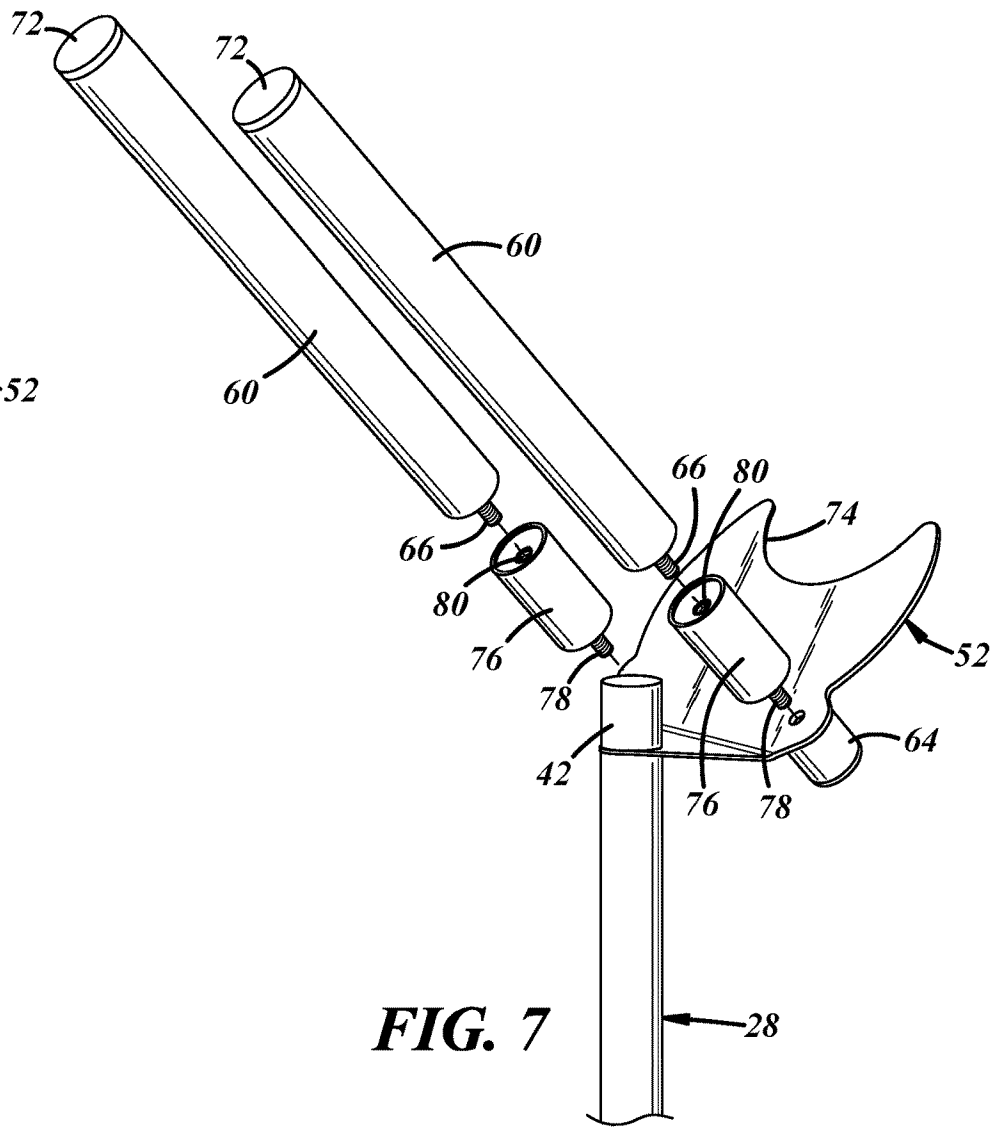
FIG. 7 is an exploded view of a portion of an embodiment f a disc golf disc stand.
Figure 6:
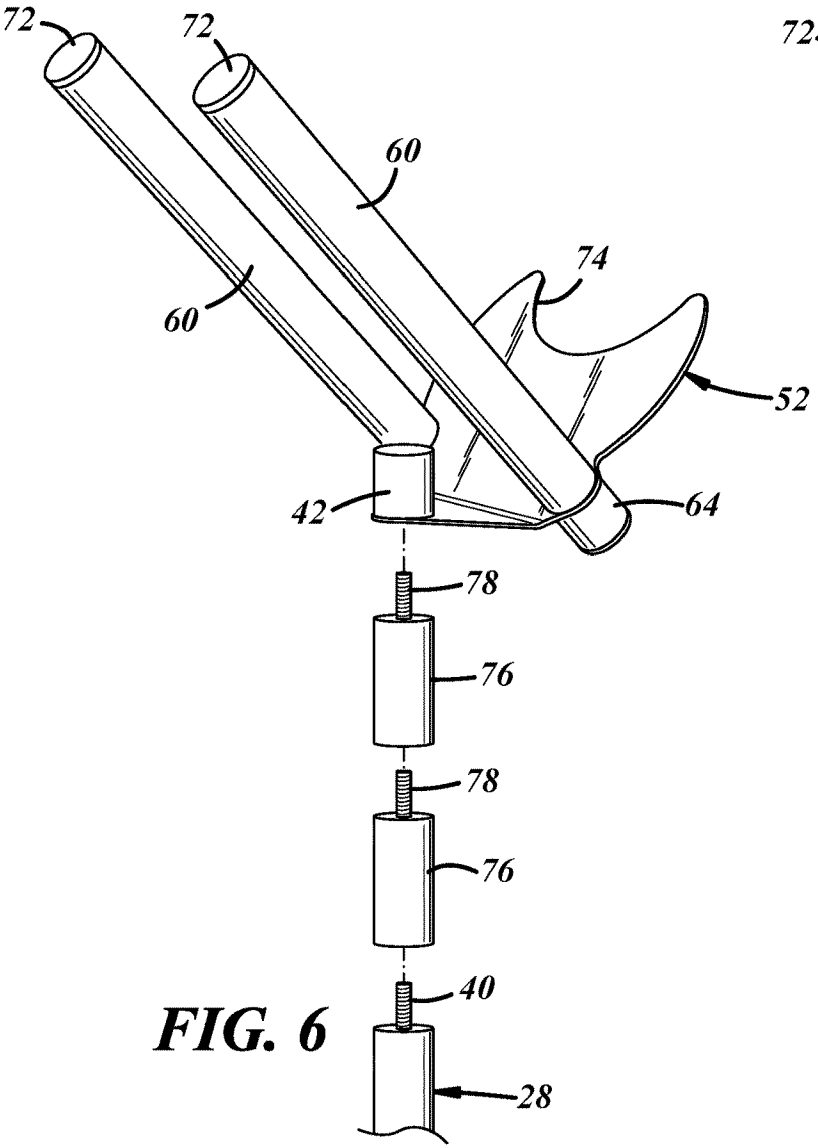
FIG. 6 is an exploded view of a portion of an embodiment f a disc golf disc stand.

FIGS. 6 and 7 show an embodiment of the disc golf disc stand 10 including extension 76. The disc golf disc stand 10 may include one or more extensions 76. The extensions 76 may be tubular having a circular cross section. The tubular cross sections of the extensions may have the same diameter as the tubular cross sections of the stand upright 28 and the stack rests 60. Each extension 76 includes a threaded member 78 on one end thereof. Each extension 76 defines a threaded opening 80 on one end thereof, which is opposite to the end including the threaded member 78.

As shown in FIG. 6, two extensions 76 are provided. In this embodiment, one of the extensions 76 is threaded, via the threaded opening 80 thereof onto the upper end threaded extension 40 of the stand upright 28. A second extension 76 is threaded via the threaded opening 80 onto the threaded member 78 of the first extension 76. The threaded member 78 of the second extension 76 is threadedly connected to the lower end closure of the upright cap 42 in the manner set forth above. By using extensions 76, the effective height of the stand upright 28 can be adjusted. As shown, the effective height of the stand upright 28 is increased. This may be desirable for a relatively taller user of the disc golf disc stand 10. It will be appreciated that any number of extensions 76 may be used. Further, it will be appreciated that the longitudinal length of the extensions 76 may comprise any desired length.

As shown in FIG. 7, two extensions 76 are shown. In this embodiment, one extension 76 is threaded, via the threaded opening 80 onto the male threaded extensions 66 of each of the stack rests 60. The extensions 76 are then threadedly connected, via the threaded members 78 to the female threaded opening 68 of the lower portion 64 of the stack rest 60. By using extensions 76, the effective length of the stack rests 60 can be adjusted. As shown, the effective length of the stack rests 60 is increased. This may be desirable to accommodate the use of a greater number of discs. It will be appreciated that any number of extensions 76 may be used. Further, it will be appreciated that the longitudinal length of the extensions 76 may comprise any desired length. It will also be appreciated while the embodiments shown in FIGS. 6 and 7 only use extensions 76 to extend either the stand upright 28 or the stack rests 60, other embodiments may include the use of extensions 76 to simultaneously extend the length of the stand upright 28 and stack rests 60.

The description of certain embodiments above discusses that male and female threaded portions are positioned on certain components of the assembly. It will be appreciated, however, that the male and female threaded portions can be reversed in other embodiments. Further, the male and female threaded portions may, in some embodiments, may be eliminated and the respective tubular components may be coupled in different manners. By way of example, one tubular component can have a portion have a relatively smaller diameter than the diameter of the next tubular component and the adjacent components can then be coupled by a friction fit when the component having the smaller diameter is inserted into the relatively larger diameter of the adjacent component.

In order to assemble the disc golf disc stand 10, the stand base 12 comprising the basal periphery 14 which is coupled with the base coupling 16 by at least one coupling support 22. The stand upright is coupled with the base coupling 16 by securing the lower end threaded extension 38 of the stand upright with the female threaded opening 20 of the base coupling 16. The disc stack holder 52 is then secured to the upper end 32 of the stand upright 28, by positioning the opening 56 of the stack holder coupling 54 over the upper end 32 of the stand upright 28 and then placing the stand upright cap 42, and more particularly, the lower end thereof, over the stack holder coupling 54. the lower stand upright cap 42. The female threaded opening, not specifically shown, of the stand upright cap 42 receives the upper end threaded extension 40 of the stand upright 28 which when secure, traps the stack holder coupling 54 of the disc stack holder 52. At least one stack rest 60 is then secured to the stack holder base 58 by positioning the upper portion 62 of the stack rest 60 on one side of the stack holder base 58 and inserting the male threaded extension 66 through an opening 70 in the stack holder base 58. The lower portion 64 of the stack rest 60 is then positioned on the opposite side of the base plate 58 and the threaded extension 66 is received within the female threaded opening 68 of the lower portion 64 of the stack rest 60. It will be appreciated that assembly of the disc golf disc stand 10 can take place in any order.

The above disclosure has been presented in conjunction with different illustrative embodiments. Other embodiments not specifically disclosed, and modifications and variations of the disclosed embodiments, will readily suggest themselves to those of ordinary skill in the art in view of the foregoing discussion. The disclosure is intended to embrace all such modifications and variations as fall within the spirit and broad scope of the appended claims.

The invention claimed is:

1. A disc golf disc stand comprising:

a stand base including a basal periphery establishing a stand base plane, a base coupling, and a coupling support between the basal periphery and the base coupling;

a stand upright configured to be coupled to the base coupling, extending along a stand upright longitudinal axis transverse to the stand base plane, and including a lower end configured to be coupled to the base coupling, and an upper end; and a disc stack holder configured to be coupled to the stand upright, and including a stack holder coupling configured to be coupled to the upper end of the stand upright, a stack holder base coupled to the stack holder coupling and establishing a stack holder base plane, and a plurality of stack rests extending along stack rest longitudinal axes transverse to the stack holder base plane.

2. The disc golf stand of claim 1, wherein the stack holder base extends obliquely with respect to the longitudinal axis of the stand upright.

3. The disc golf disc stand of claim 1, wherein the basal periphery and the coupling support of the stand base comprise wire or rod stock.

4. The disc golf disc stand of claim 1, wherein the basal periphery is circular.

5. The disc golf disc stand of claim 1, wherein the stand upright is a tubular pole.

6. The disc golf disc stand of claim 1, wherein the stack holder base is configured to support a stack of discs.

7. The disc golf disc stand of claim 6, wherein the stack holder base comprises a plate.

8. The disc golf disc stand of claim 7, wherein the plate is circular and has a cut out area.

9. The disc golf disc stand of claim 1, wherein the plurality of stack rests include a plurality of tubular poles.

10. The disc golf disc stand of claim 1, wherein each stack rest includes an upper and a lower portion, the upper portion extends from a first side of the stack holder base and the lower portion extends from a second side of the stack holder base so as to sandwich the stack holder base between the upper and lower portions of each stack rest.

11. The disc golf disc stand of claim 9, wherein each stack rest extends along the stack rest longitudinal axis at an angle between 85 and 95 angular degrees with respect to the stack holder base plane.

12. The disc golf disc stand of claim 2, wherein a stack holder base plane extends at an angle between 30 and 60 angular degrees with respect to the longitudinal axis of the stand upright.

13. The disc golf disc stand of claim 1, further comprising an extension coupled to the upper end of the stand upright and below the stack holder coupling.

14. The disc golf disc stand of claim 1, further comprising an extension coupled to at least one of the stack rests.

15. A disc golf disc stand comprising:

a stand base including:

a basal ring establishing a stand base plane, a central base socket at a center of the basal ring, and a plurality of socket support legs coupled to and extending between the basal ring and the central base socket;

a stand upright carried in the central base socket, extending along a vertical axis transverse to the stand base plane, and including:

a lower end carried in the central base socket, and an upper end; and a disc stack holder including:

a stack holder coupling configured to be coupled with the upper end of the stand upright, a stack holder plate coupled to the stack holder coupling and establishing a stack holder base plane extending at an angle between 30 and 60 angular degrees with respect to the longitudinal axis of the stand upright, and a plurality of stack rests extending along longitudinal axes at an angle between 85 and 95 angular degrees with respect to the stack holder base plane.

* * * * *